US011421304B2

(12) United States Patent
Palanivel et al.

(10) Patent No.: US 11,421,304 B2
(45) Date of Patent: Aug. 23, 2022

(54) CASTING ALUMINUM ALLOYS FOR HIGH-PERFORMANCE APPLICATIONS

(71) Applicant: Tesla, Inc., Palo Alto, CA (US)

(72) Inventors: Sivanesh Palanivel, San Jose, CA (US); Charlie Kuehmann, Los Gatos, CA (US); Paul Edwards, Seattle, WA (US); Ethan Filip, Los Altos, CA (US)

(73) Assignee: Tesla, Inc., Austin, TX (US)

( * ) Notice: Subject to any disclaimer, the term of this patent is extended or adjusted under 35 U.S.C. 154(b) by 595 days.

(21) Appl. No.: 16/172,426

(22) Filed: Oct. 26, 2018

(65) Prior Publication Data

US 2019/0127824 A1 May 2, 2019

Related U.S. Application Data

(60) Provisional application No. 62/577,516, filed on Oct. 26, 2017.

(51) Int. Cl.
*C22C 21/02* (2006.01)
*B22D 21/00* (2006.01)
(Continued)

(52) U.S. Cl.
CPC ..... *C22C 21/02* (2013.01); *B22D 21/007* (2013.01); *C22C 21/04* (2013.01); *C22C 1/1036* (2013.01); *C22C 32/0073* (2013.01)

(58) Field of Classification Search
None
See application file for complete search history.

(56) References Cited

U.S. PATENT DOCUMENTS 3,392,015 A 7/1968 Badia et al.
5,223,050 A * 6/1993 Bryant ..... C22F 1/05 148/415
(Continued)

FOREIGN PATENT DOCUMENTS

CN 1107897 9/1995
CN 101787454 7/2010
(Continued)

OTHER PUBLICATIONS

Engin et al., Nov. 19, 2015, The effects of microstructure and growth rate on microhardness, tensile strength, and electrical resistivity for directionally solidified Al—Ni—Fe alloys, Journal of Alloys and Compounds, 660:23-31.
(Continued)

*Primary Examiner* — George Wyszomierski
*Assistant Examiner* — Janell C Morillo
(74) *Attorney, Agent, or Firm* — Knobbe, Martens, Olson & Bear, LLP

(57) ABSTRACT

In various embodiments, aluminum alloys having yield strengths greater than 120 MPa, and typically in the range from 140 MPa to 175 MPa, are described. Further, such alloys can have electrical conductivity of greater than 45% IACS, typically in the range from 45-55% IACS. In one embodiment, the aluminum alloy comprises Si from 1 to 4.5 wt %, Mg from 0.3 to 0.5 wt %, $TiB_2$ from 0.02 to 0.07 wt %, Fe less than 0.1 wt %, Zn less than 0.01 wt %, Cu less than 0.01 wt %, Mn less than 0.01 wt %, the remaining wt % being Al and incidental impurities. Such alloys can be used to cast a variety of automotive parts, including rotors, stators, busbars, inverters, and other parts.

15 Claims, 4 Drawing Sheets

(51) Int. Cl.

| | |
|---|---|
| ***C22C 1/10*** | (2006.01) |
| ***C22C 21/04*** | (2006.01) |
| *C22C 32/00* | (2006.01) |

(56) References Cited

U.S. PATENT DOCUMENTS

| | | | | |
|---|---|---|---|---|
| 5,595,615 | A * | 1/1997 | Shibata | B22D 15/005 148/440 |
| 2007/0125460 | A1* | 6/2007 | Lin | B22D 21/007 148/549 |
| 2018/0305793 | A1* | 10/2018 | Gartner | B22D 18/02 |

FOREIGN PATENT DOCUMENTS

| | | | | |
|---|---|---|---|---|
| CN | 102333897 | | 1/2012 | |
| CN | 102786955 | | 11/2012 | |
| CN | 104341776 | | 2/2015 | |
| CN | 104357721 | | 2/2015 | |
| CN | 104372216 | | 2/2015 | |
| CN | 104630579 | | 5/2015 | |
| CN | 104962792 | | 10/2015 | |
| CN | 105603272 | | 5/2016 | |
| CN | 107587004 | | 1/2018 | |
| EP | 1 471 157 | | 10/2004 | |
| EP | 2 924 137 | | 9/2015 | |
| FR | 2827305 | A1 * | 1/2003 | C22C 21/04 |
| JP | 2000-204428 | | 7/2000 | |

OTHER PUBLICATIONS

Pandey et al., Oct. 20, 2017, Development of high-strength high-temperature cast Al—Ni—Cr alloys through evolution of a novel composite eutectic structure, Metallurgical and Materials Transactions A: Physical Metallurgy & Materials Science, 48(12):5940-5050.

Suwanpreecha et al., Oct. 13, 2017, New generation of eutectic Al—Ni casting alloys for elevated temperature services, Materials Science and Engineering: A, 709:46-54.

Lu et al., 2010, Development of high search rate and high yield strength gallium alloy, Jiangxi Nonferrous Metals, Issue 3.

* cited by examiner

CASTING ALUMINUM ALLOYS FOR HIGH-PERFORMANCE APPLICATIONS

CROSS REFERENCE TO RELATED APPLICATIONS

The present U.S. Utility Patent Application claims priority pursuant to 35 U.S.C. § 119(e) to U.S. Provisional Application No. 62/577,516, entitled "CASTING ALUMINUM ALLOYS FOR HIGH-PERFORMANCE APPLICATIONS," filed Oct. 26, 2017, which is hereby incorporated herein by reference in its entirety and made part of the present U.S. Utility Patent Application for all purposes.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISC

Not applicable.

BACKGROUND

Technical Field

The present invention relates to aluminum alloys. More specifically, the present invention relates to aluminum alloys with high strength, enhanced conductivity, and improved castability for high-performance applications including automobile parts.

Description of Related Art

Commercial cast aluminum alloys fall into one of two categories—either possessing high yield strength or possessing high conductivity. For example, the A356 aluminum alloy has a yield strength of greater than 175 MPa, but has a conductivity of approximately 40% IACS. Conversely, the 100.1 aluminum alloy has a conductivity of greater than 50% IACS, but a yield strength of less than 50 MPa. For certain applications, for example, parts within an electric vehicle like a rotor or an inverter, both high strength and conductivity are desired. Further, because it is desired to form these electric-vehicle parts through a casting process, wrought alloys cannot be used.

It may be desirable to produce cast aluminum alloys with high yield strength such that the alloys do not fail easily while also containing sufficient conductivity for various applications. The aluminum alloys may be used in different automotive parts, including rotors, stators, busbars, inverters, and other parts. Current cast alloys do not well serve these parts the application of the parts. There still remains a need to develop cast aluminum alloys with high strength, improved conductivity, and sufficient castability.

DETAILED DESCRIPTION OF THE DISCLOSURE

Summary

Figure 1:
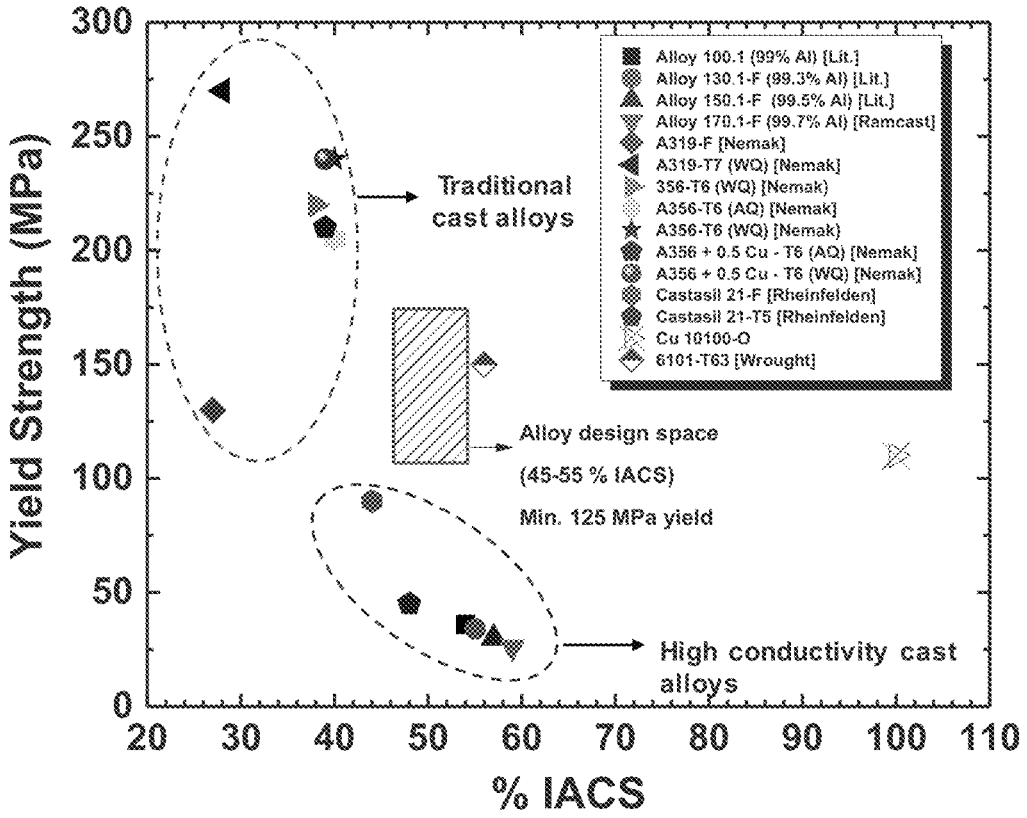
FIG. 1. illustrates known cast aluminum alloys on a yield strength verses conductivity plot, one wrought aluminum alloy, one copper alloy, and the alloy design space of the present disclosure.

Casting aluminum alloys are described herein. The disclosed aluminum alloys are aluminum alloys with high yield strength, high extrusion speed, and/or high thermal conductivity. In certain variations, the alloys are press quenchable, allowing processing without additional subsequent solution heat treatment while not compromising the ability to form an aluminum alloy having a high yield strength as described herein. The aluminum alloys are designed for use with casting techniques. Die casting is preferentially used, although sand casting (green sand and dry sand), permanent mold casting, plaster casting, investment casting, continuous casting, or another casting type may be used.

In various embodiments, the aluminum alloy comprises silicon (Si) from 1 to 4.5 wt %, magnesium (Mg) from 0.3 to 0.5 wt %, titanium diboride ($TiB_2$) from 0.02 to 0.07 wt %, iron (Fe) less than 0.1 wt %, zinc (Zn) less than 0.01 wt %, copper (Cu) less than 0.01 wt %, manganese (Mn) less than 0.01 wt %, the remaining wt % being aluminum (Al) and incidental impurities.

In other embodiments, the aluminum alloy comprises Si from 1 to 1.3 wt %, Mg from 0.3 to 0.5 wt %, $TiB_2$ from 0.02 to 0.07 wt %, Fe less than 0.1 wt %, Zn less than 0.01 wt %, Cu less than 0.01 wt %, Mn less than 0.01 wt %, the remaining wt % being Al and incidental impurities.

In other embodiments, the aluminum alloy comprises Si from 3.8 to 4.3 wt %, Mg from 0.3 to 0.5 wt %, $TiB_2$ from 0.02 to 0.07 wt %, Fe less than 0.1 wt %, Zn less than 0.01 wt %, Cu less than 0.01 wt %, Mn less than 0.01 wt %, the remaining wt % being Al and incidental impurities.

In other embodiments, the aluminum alloy composition comprises Si in the range of 1 to 4.5 wt %, Mg in the range of 0.3 to 0.5 wt %, Sr in the range of 0.02 to 0.06 wt %, Fe in the range from 0.1 to 0.3 wt %, Zn in the range less than 0.01 wt %, Cu in the range less than 0.01 wt %, Mn in the range less than 0.01 wt %, with the remaining composition (by wt %) being Al and incidental impurities.

In other embodiments, the aluminum alloy composition comprises Si in the range of 3 to 4.5 wt %, Mg in the range of 0.3 to 0.5 wt %, $TiB_2$ in the range of 0.02 to 0.07 wt, Fe in the range from 0.1 to 0.3 wt %, Zn in the range less than 0.01 wt %, Cu in the range less than 0.01 wt %, Mn in the range of 0.2 to 0.4 wt %, with the remaining composition (by wt %) being Al and incidental impurities.

Such aluminum alloys can have yield strengths greater than 120 MPa, and typically in the range from 140 MPa to 175 MPa. Further, such alloys can have electrical conductivity of greater than 45% IACS, typically in the range from 45-55% IACS.

Additional embodiments and features are set forth in part in the description that follows, and in part will become apparent to those skilled in the art upon examination of the specification, or may be learned by the practice of the embodiments discussed herein. A further understanding of the nature and advantages of certain embodiments may be realized by reference to the remaining portions of the specification and the drawings, which forms a part of this disclosure.

Detailed Description

The present disclosure may be understood by reference to the following detailed description, taken in conjunction with the drawings as described below. It is noted that, for purposes of illustrative clarity, certain elements in various drawings may not be drawn to scale, may be represented schematically or conceptually, or otherwise may not correspond exactly to certain physical configurations of embodiments.

Figure 2:
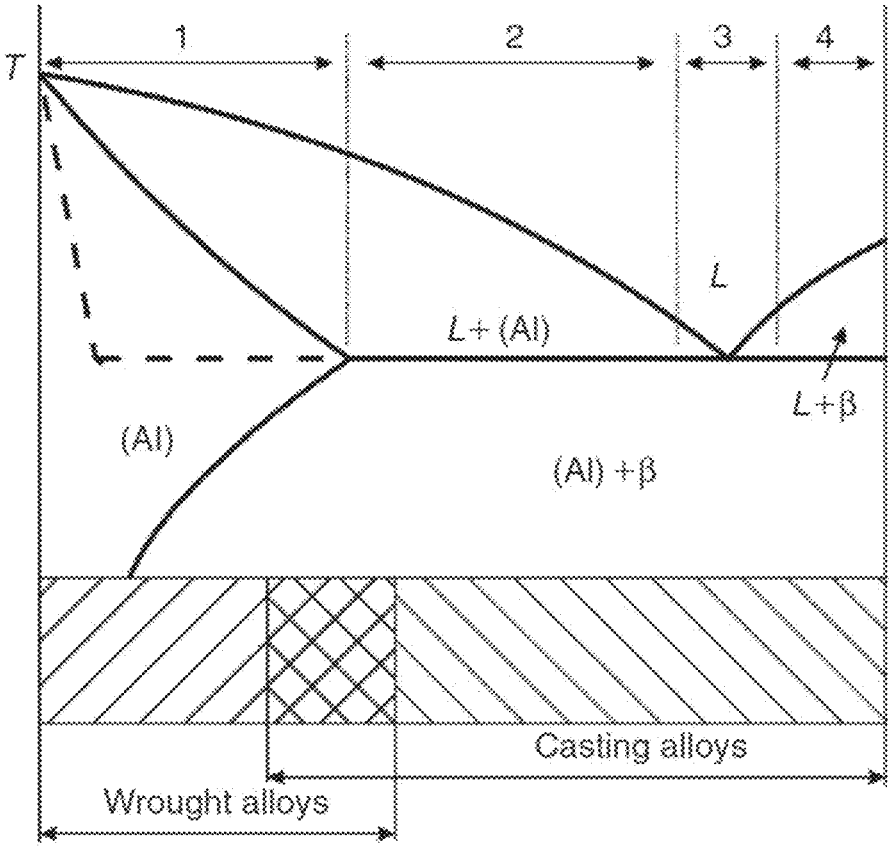
FIG. 2. illustrates a eutectic diagram showing the general range of compositions that are considered for wrought alloys and casting alloys.

FIG. 1. illustrates known cast aluminum alloys on a yield strength verses conductivity plot, one wrought aluminum alloy (6101-T63), one copper alloy (10100-O), and the alloy design space of the present disclosure. As can be observed from FIG. 1, the aluminum allows can be grouped into two general groups—those that have high strength, but low conductivity and those that have high conductivity but low strength. These aluminum alloys are not suitable for certain parts within an electric vehicle made by casting. FIG. 1 also shows the yield strength and conductivity of the wrought aluminum alloy 6101-T63. It has more desirable properties which are imparted through processing steps to create the wrought alloy. However, casting alloys do not undergo the same processing as wrought alloys and thus, properties, such as yield strength, cannot be increased through the processing steps used to form wrought alloys. FIG. 2. illustrates a eutectic diagram that shows the best processing showing the general range of compositions that are considered for wrought alloys and casting alloys. The eutectic point is typically considered the most castable composition, with compositions that deviate from the eutectic composition becoming less castable and more likely to be used as wrought alloys.

Out of the casting commercial alloys that have high conductivity, Castasil 21-F has the electrical and mechanical properties that are closest to those needed for use in electric vehicle parts—with conductivity of 44% IACS and yield strength of 85 MPa. However, these properties are still insufficient for creating parts via casting techniques for use in electric vehicles, which require conductivity of at least 45% IACS and yield strength of 120 MPa or greater.

In addition to sufficient yield strength and conductivity, when cast, the casting aluminum alloy must provide sufficient resistance to hot tearing. Hot tearing is a common and catastrophic defect observed when casting alloys, including aluminum alloys. Without being able to prevent hot tearing in alloy, reliable and reproducible parts cannot be created.

Hot tearing is the formation of an irreversible crack while the cast part is still in the semisolid casting. Although hot tearing is often associated with the casting process itself—linked to the creation of thermal stresses during the shrinkage of the melt flow during solidification, the underlying thermodynamics and microstructure of the alloy plays a part. It was an aim of the present disclosure to create an aluminum alloy composition that would reduce the instances of hot tearing so that the application can be used in the casting process.

Aluminum Alloy Compositions

The present disclosure is directed to casting aluminum alloys with both high yield strength and high conductivity. The aluminum alloys have high yield strength and high electrical conductivity compared to conventional, commercially available aluminum alloys. The aluminum alloys are described herein by the weight percent (wt %) of the elements and particles within the alloy, as well as specific properties of the alloys. It will be understood that the remaining composition of any alloy described herein is aluminum and incidental impurities. Impurities may be present in the starting materials or introduced in one of the processing and/or manufacturing steps to create the aluminum alloy. In embodiments, the impurities are less than or equal to approximately 2 wt %. In other embodiments, the impurities are less than or equal approximately 1 wt %. In further embodiments, the impurities are less than or equal approximately 0.5 wt %. In still further embodiments, the impurities are less than or equal approximately 0.1 wt %.

The aluminum alloy composition can include Si in the range of 1 to 4.5 wt %, Mg in the range of 0.3 to 0.5 wt %, $TiB_2$ in the range of 0.02 to 0.07 wt %, Fe in the range less than 0.1 wt %, Zn in the range less than 0.01 wt %, Cu in the range less than 0.01 wt %, Mn in the range less than 0.01 wt %, with the remaining composition (by wt %) being Al and incidental impurities.

In certain embodiments, the aluminum alloy composition includes Si in the range of 1 to 1.3 wt %, Mg in the range of 0.3 to 0.5 wt %, $TiB_2$ in the range of 0.02 to 0.07 wt %, Fe in the range less than 0.1 wt %, Zn in the range less than 0.01 wt %, Cu in the range less than 0.01 wt %, Mn in the range less than 0.01 wt %, with the remaining composition (by wt %) being Al and incidental impurities.

In other embodiments, the aluminum alloy composition includes Si in the range of 3.8 to 4.3 wt %, Mg in the range of 0.3 to 0.5 wt %, $TiB_2$ in the range of 0.02 to 0.07 wt %, Fe in the range less than 0.1 wt %, Zn in the range less than 0.01 wt %, Cu in the range less than 0.01 wt %, Mn in the range less than 0.01 wt %, with the remaining composition (by wt %) being Al and incidental impurities.

In other embodiments, the aluminum alloy composition includes Si in the range of 1 to 4.5 wt %, Mg in the range of 0.3 to 0.5 wt %, Sr in the range of 0.02 to 0.06 wt %, Fe in the range from 0.1 to 0.3 wt %, Zn in the range less than 0.01 wt %, Cu in the range less than 0.01 wt %, Mn in the range less than 0.01 wt %, with the remaining composition (by wt %) being Al and incidental impurities.

In other embodiments, the aluminum alloy composition includes Si in the range of 2 to 4.5 wt %, Mg in the range of 0.3 to 0.5 wt %, $TiB_2$ in the range of 0.02 to 0.07 wt, Fe in the range from 0.1 to 0.3 wt %, Zn in the range less than 0.01 wt %, Cu in the range less than 0.01 wt %, Mn in the range of 0.2 to 0.4 wt %, with the remaining composition (by wt %) being Al and incidental impurities.

The yield strength of the aluminum alloys described herein can be greater than approximately 120 MPa. In certain embodiments, the yield strength is greater than approximately 150 MPa. The electrical conductivity of the aluminum alloys described herein can be greater than approximately 45% IACS. In other embodiments, the aluminum alloys described herein can be greater than approximately 49% IACS. In other embodiments, the aluminum alloys described herein can be greater than approximately 50% IACS.

The compositions, treatment method, yield strength, and conductivity for exemplary aluminum alloys of the present disclosure are depicted in Table 1 below, which are based on the testing of multiple (typically a minimum of three) coupons for both hardness and conductivity. The aluminum alloys have increased yield strength compared to the high conductivity cast alloys shown in FIG. 1 and increased conductivity compared to the traditional cast alloys.

TABLE 1

| Sample Group | Si | Mg | Fe | Mn | $TiB_2$ | Sr | Treatment | Hardness (HV 0.3) | Conductivity (% IACS) |
|---|---|---|---|---|---|---|---|---|---|
| A | 1 | 0.5 | | | | | As Cast | 58-63 | 46-48 |
| B | 1 | 0.5 | | | | | Aged (T5) | 60-65 | 51-53 |
| C | 1 | 0.5 | | | | | Aged (T6) | 90-100 | 48-50 |
| D | 1 | 0.5 | | | | | Aged (T7) | 55-58 | 52-54 |
| E | 3.5 | 0.5 | | | | | As Cast | 65-70 | 45-47 |
| F | 3.5 | 0.5 | | | | | Aged (T5) | 63-68 | 49-51 |
| G | 3.5 | 0.5 | | | | | Aged (T6) | 88-95 | 48-50 |
| H | 3.5 | 0.5 | | | | | Aged (T7) | 63-67 | 50-52 |
| I | 3.5 | 0.5 | 0.2 | 0.3 | 0.05 | | As Cast | 65-70 | 41-43 |
| J | 3.5 | 0.5 | 0.2 | 0.3 | 0.05 | | Aged (T5) | 63-68 | 46-48 |
| K | 3.5 | 0.5 | 0.2 | 0.3 | 0.05 | | Aged (T6) | 88-95 | 46-48 |
| L | 3.5 | 0.5 | 0.2 | 0.3 | 0.05 | | Aged (T7) | 63-67 | 47-49 |
| M | 3.5 | 0.5 | 0.2 | | | 0.04 | As Cast | 65-70 | 40-42 |
| N | 3.5 | 0.5 | 0.2 | | | 0.04 | Aged (T5) | 63-68 | 45-47 |
| O | 3.5 | 0.5 | 0.2 | | | 0.04 | Aged (T6) | 88-95 | 46-48 |
| P | 3.5 | 0.5 | 0.2 | | | 0.04 | Aged (T7) | 63-67 | 46-48 |
| Q | 4.5 | 0.5 | | | | | As Cast | 67-72 | 40-43 |
| R | 4.5 | 0.5 | | | | | Aged (T5) | 65-70 | 44-46 |
| S | 4.5 | 0.5 | | | | | Aged (T6) | 90-95 | 45-47 |
| T | 4.5 | 0.5 | | | | | Aged (T7) | 64-68 | 46-48 |

Compositions are listed as weight percentages. In place of yield strength, hardness values are listed. Hardness is related to the yield strength through the relationship of $HV \approx 3\sigma_y$, where HV is the hardness value and $\sigma_y$ is the yield stress.

Yield strengths of the aluminum alloys can be determined indirectly by measuring the hardness value and then calculating the yield stress based on the hardness value. Hardness can be determined via ASTM E18 (Rockwell Hardness), ASTM E92 (Vickers Hardness), or ASTM E103 (Rapid Indentation Hardness) and then calculating the yield strength. Yield strength can also be determined directly via ASTM E8, which covers the testing apparatus, test specimens, and testing procedure for tensile testing. Electrical conductivity of the aluminum alloys may be determined via ASTM E1004, which covers determining electrical conductivity using the electromagnetic (eddy-current) method, or ASTM B193, which covers determining electrical resistivity of conductor materials.

As shown in Table 1, exemplary aluminum alloys of the present disclosure A-T have differing concentrations of elements and particles including Si, Mg, Fe, Mn, $TiB_2$, and Al, were tested. The alloys have a yield strength of at least 120 MPa and conductivity of at least 40% IACS, with most alloys having at above 45% IACS. The addition of silicon improves castability but reduces conductivity. Theoretical calculations and experimental results were performed in alloy systems with Mg in the range of 0.3 to 0.5 wt % and varying amounts of Si. The results show that up to concentrations of roughly 1.3% Si, Si can be retained in the solid solution in the presence of the other alloy elements. Thus, in embodiments, the aluminum alloy will have concentrations of up to 1.3% Si. Castability is improved with concentrations of 1% Si and above, thus in embodiments, the aluminum alloy will have concentrations of 1% and over Si. In other embodiments, the aluminum alloy will have aluminum concentrations of between 1-1.3% (to improve castability while allowing the silicon to be retained within the solid solution with the other alloying elements, as desired). When silicon reaches 3.5% by weight of the aluminum alloy, the castability is improved and produces highly castable parts. However, once the concentration of silicon is more than 4%, the conductivity is only 43% IACS, which is below the desired conductivity threshold of 45% IACS.

During cooling of the aluminum alloys that contain iron, different intermetallic phases may form. Magnesium and manganese can be added to help control the phases as described above. Table 2 illustrates four different phases (α, β, π, and δ phases), the composition of each phase, and three stochiometry ratios (iron to total, silicon to total, and iron to silicon).

TABLE 2

| Intermetallic Phase | Phase | Stoichiometry | | |
|---|---|---|---|---|
| Name | Composition | Fe:Total | Si:Total | Fe:Si |
| α | $Al_8Fe_2Si$ | 1:5.5 | 1:11 | 2:1 |
| | $Al_{15}(Fe,Mn)_3Si_2$ | 1:6.6 | 1:10 | 1.5:1 |
| β | $Al_5FeSi$ | 1:7 | 1:7 | 1:1 |
| π | $Al_{18}Mg_3FeSi_6$ | 1:18 | 1:3 | 1:6 |
| δ | $Al_4FeSi_2$ | 1:7 | 1:3.5 | 1:2 |

Elements and Particles

The different elements and particles included as part of the aluminum alloy can alter the properties of the aluminum alloy, and in particular the intermetallic phases. The following descriptions generally describe the effects of including an element or particle (in the case of titanium diboride) in the aluminum alloy.

Si

In certain embodiments, the aluminum alloy of the present disclosure contains silicon. Silicon is primarily added to improve the castability of the alloy, and reduce volumetric shrinkage.

Fe

In certain embodiments, the aluminum alloy of the present disclosure contains iron. Iron increases the resistance to die-soldering thereby increasing the overall tool life, but can negatively impact the mechanical properties, including ductility, and fatigue due to tendency to form the detrimental β phase.

Mn

In certain embodiments, the aluminum alloy of the present disclosure contains manganese. Manganese can suppress the formation of certain phases (typically the β phase) and promotes the formation of other phases (typically the α phase). The α phase leads to higher ductility, and better fatigue life.

Mg

In certain embodiments, the aluminum alloy of the present disclosure contains magnesium. Magnesium can transform certain phases (typically the β phase) into another phase (such as the π phase). Magnesium is primarily added to strengthen the alloy by precipitation strengthening.

Sr

In certain embodiments, the aluminum alloy of the present disclosure contains strontium. Strontium has also shown to fragment iron intermetallics and change morphology in addition to spheroidizing the eutectic silicon.

$TiB_2$

In certain embodiments, the aluminum alloy of the present disclosure contains titanium diboride. Titanium diboride is a hard ceramic. It is primarily added to refine the grains. The inclusion of titanium diboride into an alloy helps to increase both mechanical properties, for example, yield stress and also electrical conductivity as well as improve castability by increasing the resistance to hot-tearing.

Processing Methods

In some embodiments, a melt for an alloy can be prepared by heating the alloy. After the melt is cast and cooled to room temperature, the alloys may go through various heat treatments, aging, cooling at specific rates, and refining or melting. The processing conditions can create larger or smaller grain sizes, increase or decrease the size and number of precipitates, and help minimize as-cast segregation.

In certain embodiments, the aluminum alloy is cast without further processing. In other embodiments, the as-cast aluminum alloy is aged. In certain embodiments, the aluminum alloy is aged according to a T5 process which involves casting followed by cooling (such as air cool, hot water quench, post quench, or another type of quenching or cooling), then 250° C.+/−5° C. for 2 hours+/−15 min (including temperature ramp up and down time), then air cooling. In other embodiments, the aluminum alloy is aged according to a T6 process which involves casting, followed by heating at 540° C.+/−5 C for 1.75 hours+/−15 min (including temperature ramp up and down time), then hot water quench, then 225° C. for 2 hours+/−15 min (entire time), then air cooling. In still other embodiments, the aluminum alloy is aged according to a T7 process, which involves casting, followed by heating at 540° C.+/−5 C for 1.75 hours+/−15 min (including temperature ramp up and down time), then hot water quench, then 250° C. for 2 hours+/−15 min (entire time), then air cooling.

In certain embodiments, the after the aluminum-alloy melt has been formed, it may be cast into a die to form a high-performance product or part. Such products can be any product known in the art. The parts can be part of an automobile, such as rotors, stators, busbars, inverters, and other parts of an electric vehicle or a gas-combustion vehicle.

Figure 4B:
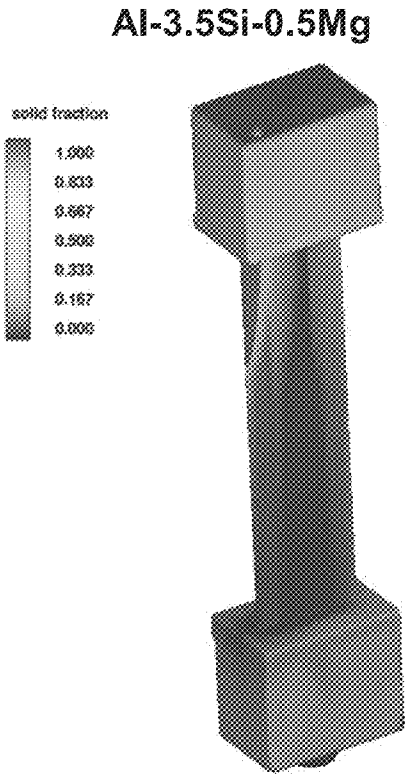
FIG. 4B illustrates a casting simulation of a part an aluminum alloy with 3.5 wt % silicon and 0.5% magnesium.
Figure 4A:
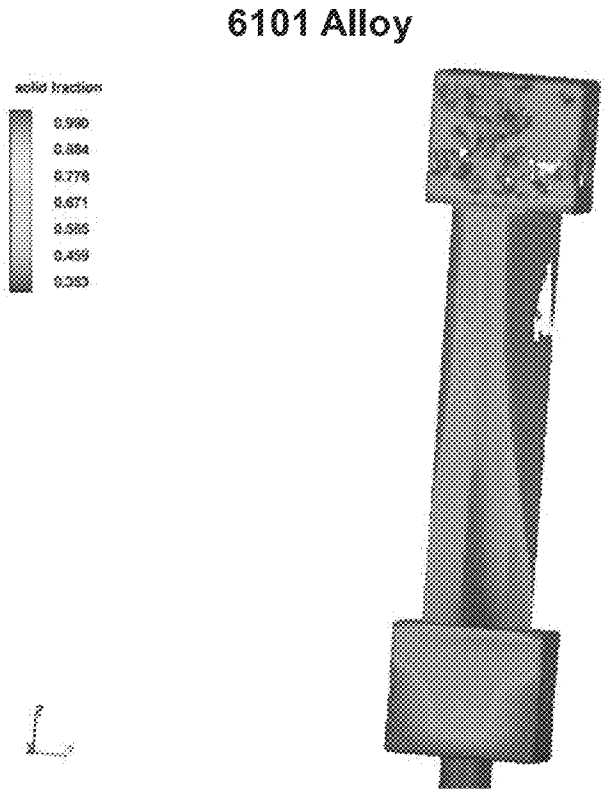
FIG. 4A illustrates a casting simulation of a part using the 6101, commercially available aluminum alloy.

FIGS. 4A and 4B show the results of simulations of casting a generic part using a single gate and no preheating of the die. FIG. 4A shows the result of a casting simulation using the 6101, commercially available aluminum alloy. FIG. 4B illustrates the results of a casting simulation using an aluminum alloy with 3.5 wt % silicon and 0.5% magnesium. The results of the simulations shown in FIGS. 4A and 4B show that the aluminum alloy with 3.5 wt % silicon and 0.5% magnesium performs much better for castability than the 6101 aluminum alloy. For example, when attempting to cast the 6101 aluminum alloy, the exemplary part begins to solidify before filling the bar and end-rings, creating what would be an unacceptable part for use in a commercial application, for example, as a part included in an electric vehicle. FIG. 4B shows that casting the aluminum alloy with 3.5 wt % silicon and 0.5 wt % magnesium does not solidify as rapidly, and a better final product may be made. Also, of note, because the 6101 aluminum alloy was not processed into a wrought alloy (but was rather cast), it would not have the mechanical and electrical properties as shown in FIG. 1. These properties are the result of the processing to create the wrought alloy.

Figure 3A:
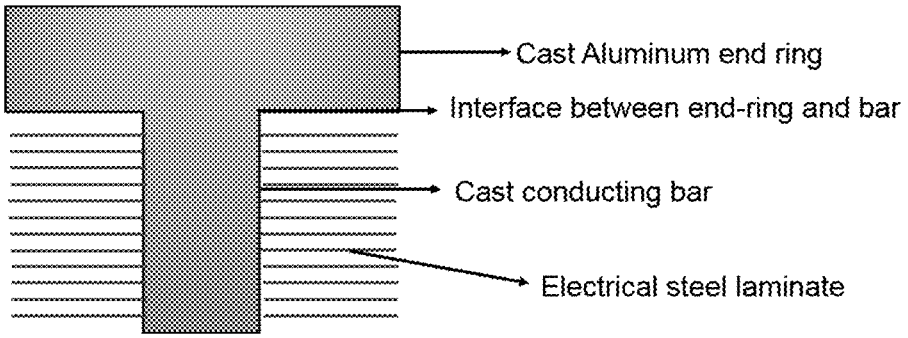
FIG. 3A illustrates a design of a rotor made using the aluminum alloys of the present disclosure.
Figure 3B:
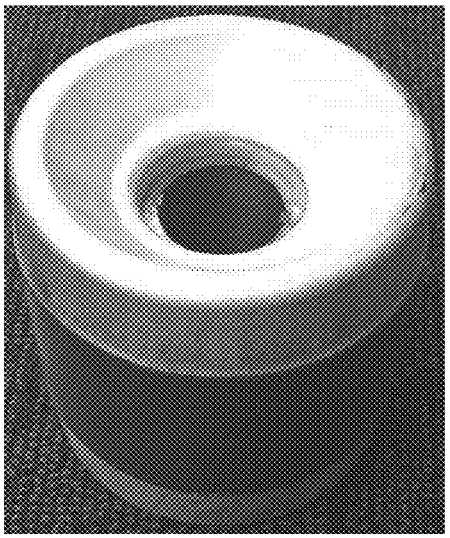
FIG. 3B is a photograph of a cast rotor according to embodiments of the present disclosure.
Figure 3C:
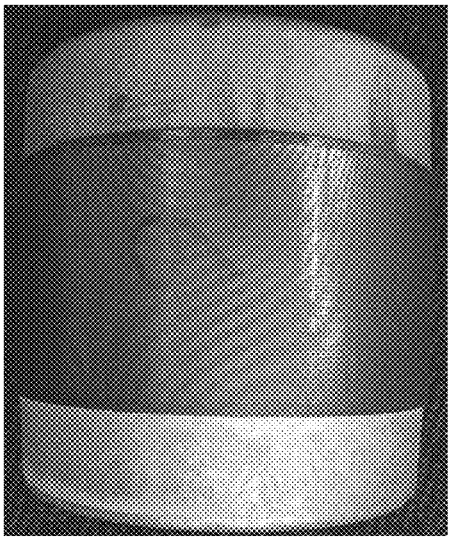
FIG. 3C is a photograph of a cast rotor according to embodiments of the present disclosure, taken from a different angle than the photograph shown in FIG. 3B.

FIG. 3A illustrates a design of a novel rotor that could be made using the aluminum alloys of the present disclosure. The cast aluminum end ring, conducting bar, and laminations may all be formed from the injection of the aluminum alloy in a single die. Alternatively, the parts may be formed separately and then joined together. FIGS. 3B and 3C show a cast rotor formed by casting an aluminum alloy of the present disclosure into a die.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed system, method, and computer program product. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure.

As used herein, the terms "comprises," "comprising," "includes," "including," "has," "having" or any contextual variants thereof, are intended to cover a non-exclusive inclusion. For example, a process, product, article, or apparatus that comprises a list of elements is not necessarily limited to only those elements, but may include other elements not expressly listed or inherent to such process, product, article, or apparatus. Further, unless expressly stated to the contrary, "or" refers to an inclusive or and not to an exclusive or. For example, a condition "A or B" is satisfied by any one of the following: A is true (or present) and B is false (or not present), A is false (or not present) and B is true (or present), and both A and B is true (or present).

Although the steps, operations, or computations may be presented in a specific order, this order may be changed in different embodiments. In some embodiments, to the extent multiple steps are shown as sequential in this specification, some combination of such steps in alternative embodiments may be performed at the same time. The sequence of operations described herein can be interrupted, suspended, reversed, or otherwise controlled by another process.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

What is claimed is:

1. An alloy formed into a casted product, wherein the alloy comprises:
Si from 2 to less than 4.0 wt %,
Mg of 0.5 wt %,
$TiB_2$ from 0.02 to 0.07 wt %,
Fe less than 0.1 wt %,
Zn less than 0.01 wt %,
Cu less than 0.01 wt %,
Mn less than 0.01 wt %, and
remaining wt % being Al and incidental impurities, and wherein the electrical conductivity of the alloy is at least about 45% IACS.

2. The alloy of claim 1, cast into a rotor.

3. The alloy of claim 1, comprising Si from 3.5 to less than 4 wt %.

4. The alloy of claim 3, cast into a rotor.

5. The alloy of claim 1, wherein the yield strength of the alloy is 120 MPa or greater.

6. The alloy of claim 1, wherein the alloy comprises 3.5% Si.

7. An article comprising a cast aluminum alloy, wherein the cast aluminum alloy comprises:
Si from 2 to less than 4.0 wt %,
Mg of 0.5 wt %,
$TiB_2$ from 0.02 to 0.07 wt %,
Fe less than 0.1 wt %,
Zn less than 0.01 wt %,
Cu less than 0.01 wt %,
Mn less than 0.01 wt %, and
the remaining wt % being Al and incidental impurities, and wherein the electrical conductivity of the cast aluminum alloy is at least about 45% IACS.

8. The article of claim 7, wherein the article is an automobile part.

9. The article of claim 7, wherein the article is an electric-vehicle part.

10. The article of claim 7, wherein the article is a rotor.

11. An alloy formed into a casted product, wherein the alloy comprises:
Si in the range of 3 to less than 4.0 wt %,
Mg of 0.5 wt %,
$TiB_2$ in the range of 0.02 to 0.07 wt,
Fe in the range from 0.1 to 0.3 wt %,
Zn in the range less than 0.01 wt %,
Cu in the range less than 0.01 wt %,
Mn in the range of 0.2 to 0.4 wt %, and
the remaining wt % being Al and incidental impurities, and wherein the electrical conductivity of the alloy is at least about 45% IACS.

12. An article comprising a cast aluminum alloy, wherein the alloy comprises:
Si in the range of 3 to less than 4.0 wt %,
Mg of 0.5 wt %,
$TiB_2$ in the range of 0.02 to 0.07 wt,
Fe in the range from 0.1 to 0.3 wt %,
Zn in the range less than 0.01 wt %,
Cu in the range less than 0.01 wt %,
Mn in the range of 0.2 to 0.4 wt %, and
the remaining wt % being Al and incidental impurities, and wherein the electrical conductivity of the cast aluminum alloy is at least about 45% IACS.

13. The article of claim 12, wherein the article is an automobile part.

14. The article of claim 12, wherein the article is an electric-vehicle part.

15. A method for producing an aluminum alloy, the method comprising:
forming a melt that comprises an aluminum alloy, wherein the aluminum alloy comprises:
Si from 2 to less than 4.0 wt %,
Mg of 0.5 wt %,
$TiB_2$ from 0.02 to 0.07 wt %,
Fe less than 0.1 wt %,
Zn less than 0.01 wt %,
Cu less than 0.01 wt %,
Mn less than 0.01 wt %, and
the remaining wt % being Al and incidental impurities; and
casting the melt according to an as-cast, T5, T6, or T7 process.

* * * * *